United States Patent [19]

Byrt et al.

[11] 4,020,722

[45] May 3, 1977

[54] MACHINE DRIVE ASSEMBLIES

[75] Inventors: Graham A. B. Byrt; John E. Mockett, both of Bristol, England

[73] Assignee: Masson Scott Thrissell Engineering Limited, Bristol, England

[22] Filed: Oct. 16, 1975

[21] Appl. No.: 623,165

[30] Foreign Application Priority Data

Oct. 24, 1974 United Kingdom .....: 46134/74

[52] U.S. Cl. ..... 83/74; 83/312; 83/403.1

[51] Int. Cl.[2] ..... B26D 5/00

[58] Field of Search ..... 83/74, 76, 312, 75, 83/403.1

[56] References Cited

UNITED STATES PATENTS

| | | | |
|---|---|---|---|
| 2,070,537 | 2/1937 | Matthews | 83/312 |
| 3,128,662 | 4/1964 | Obenshain | 83/312 |
| 3,309,953 | 3/1967 | Hallden | 83/312 |
| 3,956,617 | 5/1976 | Schmidt | 83/74 |

*Primary Examiner*—Donald R. Schran
*Attorney, Agent, or Firm*—Seidel, Gonda & Goldhammer

[57] ABSTRACT

A continuous web of paper is fed from a reel by a driven roller and a cooperating pressure roller and cut into sheets by a pair of rotating knives. The shafts on which the driven roller and one of the knives are mounted, are drivingly connected by a presettably variable ratio gear box and the drive is obtained from a main motor which is connected to the driven roller shaft. A differential gear is positioned between the main motor and the driven roller, the shafts of which are connected to two of the input/outputs of the differential gear. The casing of the differential gear is connected to an auxiliary motor which is connected to a speed regulator. The speed of the web and the rotational speeds of the driven roller and the knife shaft are monitored and compared with the desired sheet length and a signal indicative of any error between the desired and actual sheet length is used to control the speed regulator.

7 Claims, 1 Drawing Figure

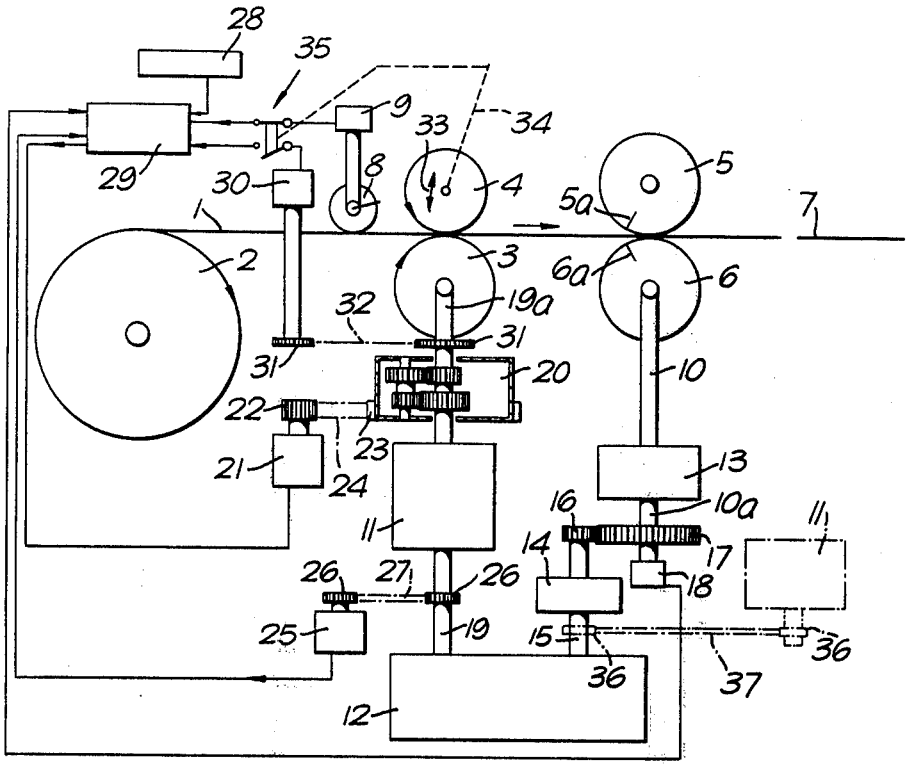
28
35
9
33
34
29
30
8
4
5
5a
7
1
2
3
6a
6
19a
32
31
31
20
10
22
23
21
24
13
10a
11
16
11
14
17
18
26
27
26
25
19
15
36
36
37
12

MACHINE DRIVE ASSEMBLIES

This invention concerns improvements in or relating to drive assemblies for machines, and in particular to drive assemblies for use in machines for cutting paper or board.

In such cutting machines it is usual to feed a continuous web of paper or board, by means of draw rollers which pull the web under tension from a reel, between a pair of knives (one or both of which may be rotated) which cut the web into discrete lengths or sheets. The length of the sheets is determined by the ratio between the number of cuts made per minute and the rate at which the web is fed between the knives. In order to meet the needs of the user it is necessary to vary the length of sheets cut within certain limits depending upon their intended end use.

To enable such variation in sheet length to be made the drive ratio between the draw rollers and the cutters is arranged to be infinitely variable. In the past this has usually been achieved either by means of a friction-drive gear box, or a belt drive of the type in which expanding and contracting Vee pulleys are adjusted in unison to change the relative diameters of the Vee pulleys and thus alter the relative speeds of input and output shafts. These forms of drive have been acceptable in the past, but when very accurate length sheets are required, the sheets have to be subsequently cut on a guillotine. With the demand for greater accuracy of sheet length and higher machine speeds, these existing drives are no longer suitable. Due to slippage in such gear boxes and belt drive the drive ratio between the draw rollers and the knives is not accurately maintained during acceleration or deceleration of the machine, and thus valuable material is wasted until the correct sheet length is obtained for any particular machine running speed. There is also a need for continuous maintenance with friction drive gear boxes of Vee belts.

Various solutions have been proposed to overcome these problems, such as Vee pulleys with automatic adjustment during acceleration and deceleration, a multi ratio gear box in combination with a differential and infinitely variable gear box, in which the latter carries only a small percentage of the drive, and, more recently two electric motors in which one motor drives the draw rollers and the other motor drives the knives, the speed of the two motors being electronically controlled at all times by a closed loop monitoring system. These devices are either very expensive or require a lot of maintenance. It is also possible with the two motor system for random electrical variations, which cannot be controlled, to cause sheet length variations, in excess of the trade tolerances, when running at low speeds as, for instance, when setting the machine up.

According to the present invention there is provided a drive assembly for a machine such as a paper cutter having a first part to be driven at a first speed and a second part to be driven at a second speed, the ratio of said first and second speeds being presettably variable, said assembly comprising an input shaft for connection to a prime mover, first and second output shafts for connection to said first and second parts of said machine, a differential gear having three input/outputs, an auxiliary input connection for connection to speed-regulating means, and a gear box settable to provide any one of a plurality of speed ratios, said gear box being connected between the first output shaft of the assembly and one input/output of the differential gear, a second input/output of the differential gear being connected to the auxiliary input connection and the third input/output of the differential gear being connected to the second output shaft of the assembly.

Conveniently the said input shaft may be arranged to be in driving connection with said first or said second output shaft.

The speed-regulating means may be of any form that allows the speed of the auxiliary input connection to be set to a desired level, i.e. it may be an auxiliary prime mover such as an electric motor, a servo motor, or it may be a brake e.g. an eddy-current brake. If an auxiliary prime mover is used then of course the speed of the auxiliary input connection may be set at a desired value in either direction while the use of a brake does not permit the direction of shaft rotation to be selected irrespective of other variables.

Further according to the invention there is provided a machine for cutting sheets from a continuous web of paper or like material comprising a reel on which said web is wound, feed means for drawing said web from said reel, means for cutting said web transverse to its direction of travel at spaced positions therealong to produce a succession of sheets, and a drive assembly to drive said cutting means at a first speed and said feed means at a second speed, the ratio of said first and second speeds being presettably variable, wherein said drive assembly comprises an input shaft for connection to a prime mover, first and second output shafts for connection to said cutting means and said feed means respectively, a differential gear having three input/outputs, an auxiliary input connection connected to speed regulating means, and a gear box settable to provide any one of a plurality of speed ratios, said gear box being connected between the first output shaft of the drive assembly and one input/output of the differential gear, a second input/output of the differential gear being connected to the auxiliary input connection and the third input/output of the differential gear being connected to the second output shaft of the drive assembly.

A preferred embodiment of the invention will now be described, by way of example only, with reference to the accompanying single schematic drawing.

A web of paper 1 is pulled from a reel 2 by means of a pair of draw rollers 3, 4 and fed between a pair of rotating cutter drums 5, 6 having knife blades 5*a*, 6*a* respectively, which cooperate once every revolution of the cutter drums to cut a sheet 7 from the web. The amount of web fed by the rollers 3, 4, to the cutters 5, 6, is monitored by a wheel 8 which is rotated by being in contact with the web 1. An encoder 9, of any convenient known form, is driven from the wheel 8 and produces a predetermined number of electrical pulses for each revolution of the wheel 8. The cutter drums 5, 6 are drivingly interconnected, and a shaft 10, on which the cutter drum 6 is fixed, is driven from a main electric motor 11. The shaft 10 is driven through a cyclic drive mechanism 13 from a shaft 10*a*, which in turn is driven from a further shaft 15, by gears 16, 17, the shaft 15 being drivingly connected to an output shaft 19 of the motor 11 by a multi ratio gear box 12. The cyclic drive mechanism 13 may be of any known form (e.g. a four bar linkage) serving to impose a cyclic speed variation on the drive to the shaft 10 so as to ensure that the speed of the knife blades 5*a*, 6*a* is equal to the linear speed of the web 1 at the moment of cut, irrespective of sheet length. To reduce the effect of the cyclic speed variation on the rest of the machine a flywheel 14 is fixed on the shaft 15. A further encoder 18 is driven from the shaft 10*a* and produces an electrical pulse each time a sheet is cut on the web 1.

The shaft 19, of the motor 11 is connected to one input/output shaft of a differential gear 20 which has another input/output shaft connected to a shaft 19*a* carrying roller 3. The casing of gear 20 (its third input-/output) is driven by an auxiliary electric motor 21, through pulleys 22, 23 and belt 24. A unit 25, of any convenient known form, is driven from the shaft 19 by rollers 26 and belt 27, and produces a d.c. voltage indicative of the rotational speed of the shaft 19, which in turn, gives an indication of the linear speed of the web 1.

The gear box 12 is of any convenient known construction such that it may be set to give one of, say, 25 speed ratios between the shafts 15, 19, the ratio selected being dependent on the length of sheet it is desired to be cut from the web 1.

The motor 21 is arranged so that it may be driven at varying speed and in either direction so that, through the differential gear 20 the speed of the draw rollers 3, 4 and thus the web 1, may be increased or decreased, without changing the setting of the gear box 12. The motor 21 is controlled by an electronic closed loop system which includes a sheet length setting unit 28, the encoders 9, 18, the unit 25, and a control unit 29, of any convenient form.

The ratio of the differential gear 20 is so arranged that only a small proportion (e.g. 4%) of power required to drive the draw rollers 3, 4 is derived from the auxiliary motor 21. However, the arrangement is such that the proportion of power supplied by the motor 21 is sufficient to make up any difference between the speed obtained by the selected setting of the gear box 12, and the speed required to enable any particular sheet length to be cut, if the speed so required falls between two speed steps of the gear box 12, and also to make up for disturbance of the web 1, due to, for example, slippage of the web as it passes between the draw rollers 3, 4 during acceleration of the machine.

In operation, the desired sheet length is set in the unit 28 and the gear box 12 is set at that ratio which would cause the cutter drums 5, 6 to be driven at the correct speed (or as near as possible to the correct speed) for obtaining the desired cut length of sheet. Pulses indicative of the speed at which the web 1 would be driven by the gear box 12 are fed from the unit 25 to the control unit 29. The wheel 8 continuously senses the rate at which web is fed to the cutters and the resulting pulses from the encoder 9 are fed to the unit 29 and compared with the set sheet length. Any error in the comparison is computed by the unit 29 which emits a signal causing the speed of the auxiliary motor 21 to be either increased or decreased accordingly, thus causing the draw rollers 3, 4, to be driven at the correct speed. Since, by means of the wheel 8, the actual rate of web feed to the cutters 5, 6 is measured, the speed of the motor 21 is controlled to compensate for any slip between the web and the rollers 3, 4 and also for any other form of web disturbance, such as tension variations.

As described above, it will be appreciated that the wheel 8 and encoder 9 must be operative for the sheet length to be controlled and hence (as wheel 8 is driven by the paper web) the apparatus cannot be set up for operation without paper being fed. To allow for this, there is also provided an encoder 30 driven through pulleys 31 and belt 32 from shaft 19*a* so that the encoder 30 delivers output pulses representing the speed of roller 3. The encoder 30 is also connected to control unit 29, but between the encoders 9, 30 and the unit 29 is a switch 35 so arranged that in one position (the normal running position) the encoder 9 is connected to, but encoder 30 is isolated from, the unit 29 while in the other (starting) position the encoder 30 is connected to unit 29 and encoder 9 is isolated. Roller 4 is a pressure roller and is movable up and down as indicated by arrow 33 so that it can be lifted from its normal running position (as drawn) against roller 3 when web feed is not required; a mechanical connection indicated by dashed line 34 between roller 4 and switch 35 causes the latter to connect encoder 9 to unit 29 when roller 4 is down, as required for normal running, and to connect encoder 30 to unit 29 when roller 4 is raised, as required for setting-up without feed of web.

In the embodiment illustrated the motors are described as electric motors, but it is to be understood that either or both could equally well be hydraulic motors controlled by a suitable servo system. The main motor 11 is shown as being between the multi-ratio gear box 12 and the draw rollers 3, 4, but it could also be placed between the multi-ratio gear box 12 and the cutter drums 5, 6, as shown in chain-dot lines in the drawing. When so placed between the gear box 12 and the cutter drums 5, 6 the motor 11 is arranged to be drivingly connected to the shaft 15 through pulleys 36 and belt 37. The differential gear 20 could also be placed in the drive to the cutters rather than the drive to the draw rollers, the choice being dependent on the relative power requirements of the various drives. Furthermore, the auxiliary electric motor 21 may be replaced by a brake (e.g. an eddy-current brake). It will be appreciated that when an electric motor is used its direction of rotation is reversible, but if the motor 21 is replaced by a brake the control capabilities are more limited. In this latter case the gear ratios would need to be such that the draw rollers 3, 4 tended to be driven at a faster speed than that required to obtain the correct sheet length, so that the casing of the differential gear 20 would have to be braked to obtain the correct speed of the rollers 3, 4.

The invention is described and illustrated as applied to a synchronous double rotary knife cutter but it is to be understood that it could equally well be applied to any other form of cutter in which it is necessary to accurately infinitely adjust the speed ratio between the web feeding system and the web cutting system.

We claim:

1. A machine for cutting sheets from a continuous web of paper or like material comprising a reel on which said web is wound, feed means for drawing said web from said reel, means for cutting said web transverse to its direction of travel at spaced positions therealong to produce a succession of sheets, and a drive assembly to drive said cutting means at a first speed and said feed means at a second speed, the ratio of said first and second speeds being presettably variable, wherein said assembly comprises a prime mover, an input shaft for connection to said prime mover, first and second output shafts for connection to said cutting means and said feed means respectively, a differential gear having three input/outputs, speed regulating means, an auxiliary input connection connected to said speed regulating means, a gear box settable to provide any one of a plurality of speed ratios, said gear box being connected between said first output shaft of said assembly and one input/output of the differential gear, a second input-/output of said differential gear being connected to said auxiliary input connection and the third input/output of the differential gear being connected to the second output shaft of said assembly, means to monitor the rate of web feed, first sensing means for producing signals indicative of the rate of web feed, second sensing means for producing signals indicative of the rotational speed of said first output shaft, third sensing means for producing signals indicative of the rotational speed of said second output shaft, presettable means for producing a signal indicative of the desired length of sheet to be cut from said web, and control means electrically connected to all said sensing means and to said presettable means, wherein said control means is adapted to produce an error signal indicative of any difference between the length of web being fed by said feed means and said desired length of web being fed by said feed means and said desired length, said speed regulating means being arranged to receive said error signal and adapted to respond thereto in such sense as to reduce said difference.

2. A machine as claimed in claim 1 in which said feed means comprises a driven roller fixed to said second output shaft and a pressure roller, said pressure roller being movable between an operative position in which said web is gripped between said driven roller and said pressure roller and an inoperative position in which said pressure roller is held away from said driven roller.

3. A machine as claimed in claim 2 including a fourth sensing means for producing a signal indicative of the rotational speed of said driven roller, said fourth sensing means being electrically connected to said control means and switch means, said switch means being operable by movement of said pressure roller so that when said pressure roller is in said operative position said first sensing means is connected to said control means, and when said pressure roller is in said inoperative position said fourth sensing means is connected to said control means.

4. A machine as claimed in claim 2 in which said first sensing means includes a wheel, said wheel being arranged to be in contact with, and rotated by, said web, said first sensing means being adapted to produce a predetermined number of electrical pulses for each revolution of said wheel.

5. A machine as claimed in claim 4 in which said speed regulating means comprises an electric motor.

6. A machine as claimed in claim 4 in which said speed regulating means comprises an hydraulic motor.

7. A machine as claimed in claim 4 in which said speed regulating means comprises a brake.

* * * * *